United States Patent [19]

Rudibaugh

[11] Patent Number: 4,795,104

[45] Date of Patent: Jan. 3, 1989

[54] MULTI-STATION MEAT GRINDER WITH BONE CHIP REMOVAL MEANS

[75] Inventor: C. Richard Rudibaugh, Chicago, Ill.

[73] Assignee: Cozzini Manufacturing Corp., Ill.

[21] Appl. No.: 102,800

[22] Filed: Sep. 24, 1987

Related U.S. Application Data

[63] Continuation of Ser. No. 871,712, Jun. 6, 1986, abandoned.

[51] Int. Cl.[4] ..... B02C 18/30

[52] U.S. Cl. ..... 241/78; 241/79; 241/82.5; 241/152 R

[58] Field of Search ..... 241/78, 79, 82.1–82.7, 241/96, 101 B, 24, 152 A, 152 R; 99/537, 538; 209/255

[56] References Cited

U.S. PATENT DOCUMENTS

| | | | |
|---|---|---|---|
| 419,104 | 1/1890 | Baltzley | 241/82.1 X |
| 3,298,057 | 1/1967 | Liebmann, Jr. | 99/537 X |
| 3,315,604 | 2/1982 | Meyenschein | 241/82.5 |
| 3,345,353 | 10/1967 | Klubien | 241/78 X |
| 3,530,913 | 9/1970 | Kline et al. | 241/78 |
| 3,743,192 | 7/1973 | Otto | 241/101 B |
| 3,971,514 | 7/1976 | Martinelli et al. | 241/82.5 X |
| 4,004,742 | 1/1977 | Hess | 241/82.5 |
| 4,240,591 | 12/1980 | Schnell | 241/82.5 X |
| 4,358,061 | 11/1982 | Richter | 241/82.5 X |
| 4,422,372 | 12/1983 | Hoezee | 241/82.5 X |
| 4,422,582 | 12/1983 | Roeger et al. | 241/82.5 |
| 4,536,920 | 8/1985 | Amersfoort | 241/82.3 |

FOREIGN PATENT DOCUMENTS

| | | | |
|---|---|---|---|
| 1136968 | 12/1982 | Canada | 241/82.5 |
| 147452 | 4/1981 | Fed. Rep. of Germany | 241/24 |

*Primary Examiner*—P. W. Echols
*Assistant Examiner*—Joseph M. Gorski

[57] ABSTRACT

A bone chip removal and ground meat separating unit for use with a meat grinding apparatus having at least one further meat processing unit downstream thereof and wherein the grinding apparatus includes a casing with a centrally apertured end cap secured thereto for holding a centrally hubbed, perforated die plate with at least one bone chip discharge channel extending through the hub, and including a ground meat discharge conduit having an entrance end adapted to be secured to the end cap for receiving ground meat extruded through the perforations, and a bone chip removal tube having one end adapted to be secured to the hub for receiving bone chips discharged through the channel and another end communicating with an exit opening in the conduit downstream of the entrance end for discharging bone chips out of the stream of ground meat being conveyed through the conduit with a valve in the tube for regulating the flow of bone chips therethrough.

21 Claims, 2 Drawing Sheets

FIG. 1
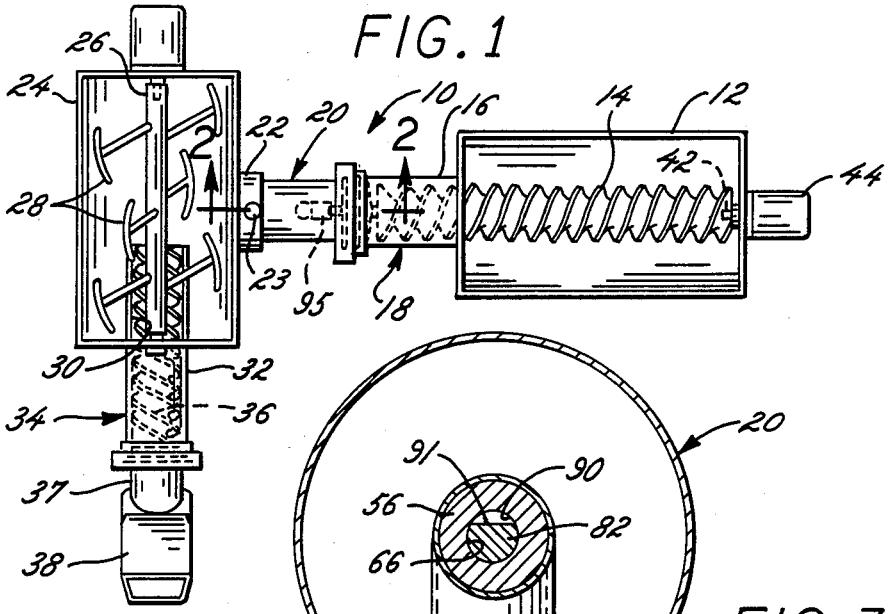
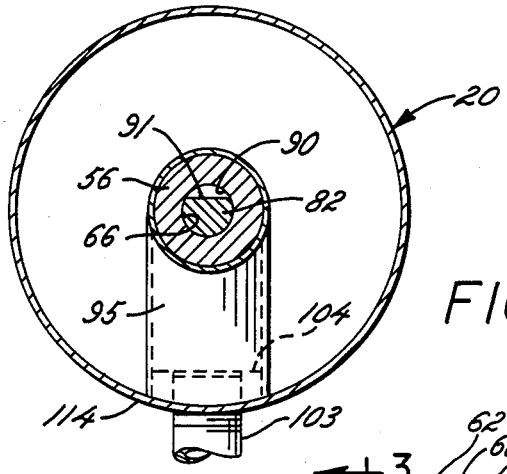
FIG. 3
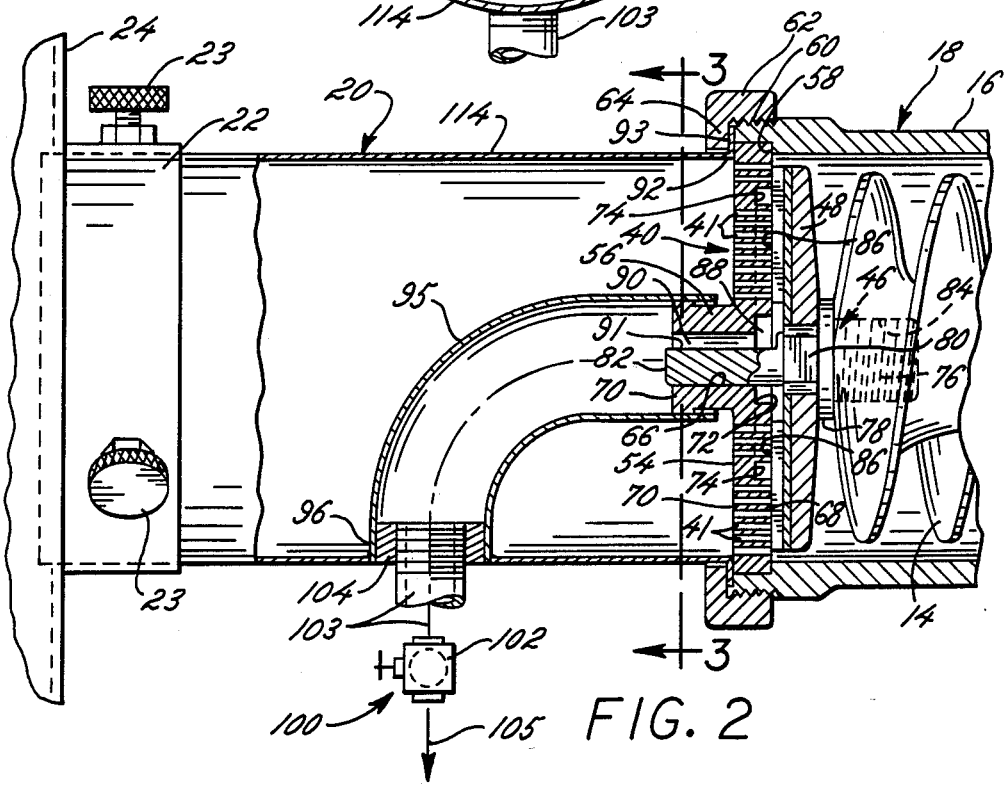
FIG. 2

MULTI-STATION MEAT GRINDER WITH BONE CHIP REMOVAL MEANS

This application is a continuation of application Ser. No. 871,712, filed June 6, 1986, now abandoned.

FIELD OF THE INVENTION

The present invention relates generally to meat grinding equipment and more particularly concerns meat grinding equipment having provision for collecting and removing bone chips out of the stream of ground meat being conveyed to a subsequent grinding or packaging unit.

BACKGROUND OF THE INVENTION

Grinding meat from large chunks into hamburger and the like typically requires repeated grinding operations to successively reduce the meat to the desired size increment, such as for hamburger. It has also long been known that meat grinding can generate numerous bone chips and gristle pieces (hereinafter called bone chips) that pass through with the final ground product and which are undesirable and/or even dangerous to the consumer of the product when eaten. To avoid the bone chip problem, large users of ground meat products, such as fast food chains and the like, generally utilize bone chip removal means in the grinding of the meat products furnished to the restaurants.

It is known in the art to remove bone chips during meat grinding by forming a bone chip collecting pocket in the upstream face of a perforated die plate and forming a radial or spiral groove in the die plate face which is swept by the grinder blades such that bone chips are first collected in the groove and then directed into the collecting pocket. U.S. Pat. No. 4,004,742 are removed from the grinder by periodically disassembling the discharge end of the grinder and dumping the bone chips from the collection pocket. More recently such apparatus has been improved by forming a groove in the auger shaft which extends through a hub in the die plate for communicating bone chips from the collection pocket, through the die plate and to a hose connected to the hub on the downstream side of the die plate. An arrangement of this type is disclosed in U.S. application Ser. No. 328,902 filed Dec. 9, 1981, and now abandoned, and typically is installed at the discharge end of the final grinder in a multi-stage or piggyback grinding set up.

Heretofore, however, bone chip removal means have not been susceptible to wide spread use by small meat users, such as individual supermarkets and meat lockers. Supermarkets, for example, commonly grind their own meat and utilize baggers, cubing devices, or other apparatus at the discharge of the meat grinding device for packaging relatively small packages of the ground meat or for forming the ground meat product into cubes, or the like. The bone chip tube extending from the downstream side of the perforated grinder plate at the discharge end of the piggyback grinding apparatus prevents the effective or efficient use of baggers, cubers or the like. Even when the ground meat is to be discharged onto a platter for sale in the supermarket, the bone chip removal tube impedes the desired manner in which the ground meat is deposited on the platter and hence is deemed undesirable even in that instance. The meat does not discharge onto the platter with the fluff or bloom customary of freshly ground meat, and desirable from a marketing standpoint in supermarkets. Instead, the meat is discharged rather haphazardly on, about, and on opposite sides of the central bone chip removal tube.

As a result, it has not been customary for small or medium meat purveyors, such as individual supermarkets and meat lockers, to remove bone chips from meat ground on their own premises. Accordingly, as is customary in such meat grinding operations, numerous bone chips are generated and pass through into the ground products sold to the public by such meat purveyors, and this in turn, results in many complaints, dissatisfied customers, and costly damage claims by persons who are in fact injured or irritated by such bone chips. Consequently, a need has long existed for a means permitting effective bone chip removal by such meat purveyors.

OBJECTS AND SUMMARY OF THE INVENTION

It is the primary aim of the present invention to provide a piggyback grinding apparatus which permits effective bone chip removal during the meat grinding operation while permitting bagging, cubing, or other ground meat processing equipment to be utilized at the discharge end of the grinding device.

It is another object to provide a multiple station grinding apparatus which permits effective bone removal during the grinding operation and which is adapted to discharge the finally ground product onto platters with customary fluff and bloom of freshly ground meat without the hindrance of a bone removal discharge tube.

Another object is to provide a connecting conduit for a multiple station meat grinding device which permits bone removal from a grinding station upstream of the final discharge station without interfering with the flow of ground meat through a closed transfer conduit connecting the individual grinding stations.

Yet another object is to provide a discharge tube for a meat grinding device which permits bone removal at the final discharge station while permitting the efficient and effective use of bagging cubing, or for plattering of the final ground meat product at such station.

SUMMARY OF THE INVENTION

In accordance with the present invention, a bone chip removal and ground meat separating unit is provided for use with a meat grinding apparatus having at least one further meat processing unit downstream thereof and wherein the grinding apparatus includes a casing with a centrally apertured end cap secured thereto for holding a centrally hubbed, perforated die plate with at least one bone chip discharge channel extending through the hub. The unit includes a ground meat discharge conduit having an entrance end adapted to be secured to the grinder end cap for receiving ground meat extruded through the perforations and a bone chip removal tube having one end adapted to be secured to the hub for receiving bone chips discharged through the channel and another end communicating with an exit opening in the conduit downstream of the entrance end for discharging bone chips out of the stream of ground meat being conveyed through the conduit.

These and other features and advantages of the invention will be more readily apparent upon reading the following description of the preferred embodiments of the invention and upon reference to the accompanying drawings wherein:

BRIEF DESCRIPTION OF THE DRAWINGS

FIG. 1 is a top plan view of a multiple stage meat grinding, mixing and bagging apparatus employing the novel ground meat conveying conduit and bone chip removal tube of the present invention between successive grinding stations;

FIG. 2 is an enlarged, fragmentary side elevation view, partly in section, of the downstream end of the first grinder and the novel meat conveying conduit and bone chip removal tube substantially as seen along line 2—2 in FIG. 1;

FIG. 3 is a cross sectional view substantially as seen along line 3—3 in FIG. 2;

Figure 4:
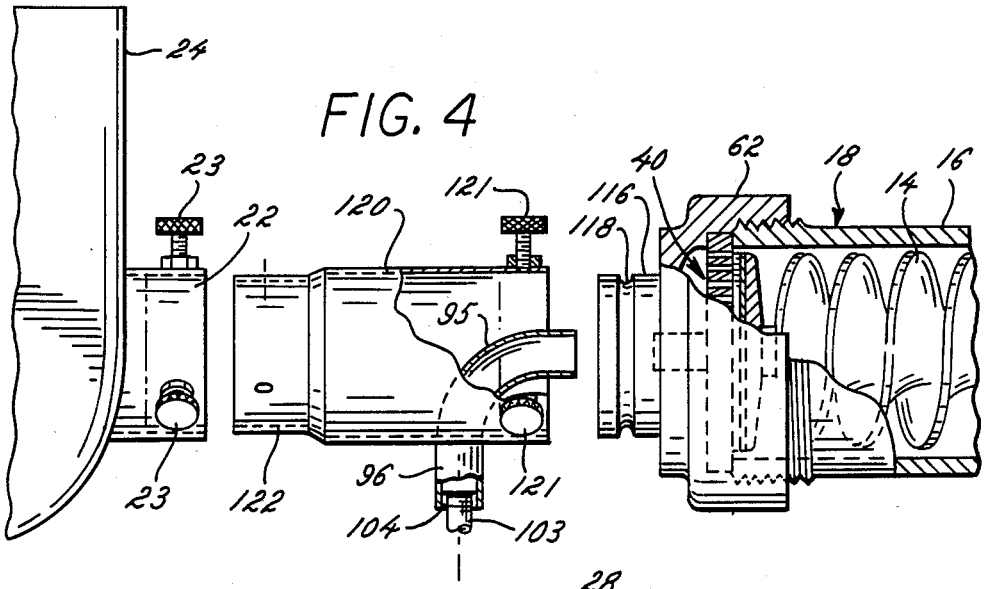
FIG. 4 is an exploded side elevational view similar to FIG. 2 showing an alternative embodiment of the ground meat conveying conduit and bone chip removal tube of the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENTS

Turning now to the drawings, there is shown in FIG. 1 a multiple stage meat grinding, mixing and bagging apparatus, indicated generally at 10. The apparatus 10 includes a meat chunk receiving hopper 12 with a motor driven axial conveyor screw or auger 14 that continues into the tubular casing 16 of a first stage meat grinder 18. A ground meat discharge conduit 20 is removably connected to the discharge end of the meat grinder 18 and an inlet coupling 22 of a meat mixing bin 24.

Disposed within the mixing bin 24 is a motor driven mixing shaft 26 which carries a plurality of generally radially extending stirring paddles 28 having a curved generally T-shaped configuration. As the mixing shaft 26 and paddles 28 are rotated within the bin 24, the ground meat is mixed, fluffed up and moved downstream in the bin 24 where it is discharged through an opening 30 into the tubular casing 32 of a second stage meat grinder 34. A motor driven auger 36 in the second grinder 34 conveys the meat through the grinder 34 and forces it out through a discharge conduit 37 into a suitable bagging unit or the like 38.

Referring more particularly to FIG. 2, the downstream end of the casing 16 of the first stage grinder 18 is closed by a perforated plate 40 also sometimes referred to as a die plate having a plurality of perforations or holes 41 extending therethrough. The plate 40 and the casing 16 form a grinding chamber at the downstream end of the auger 14. The auger 14 is supported at its upstream or forward end for rotation in the casing 16 by a shaft 42 which is driven in a conventional manner by an electric motor or other power source 44. The auger 14 is rotatably supported at its downstream or rear end by a coaxial stud or pilot member 46, which is journalled in the die plate 40. The stud 46 also supports a rotary knife 48 for rotation in unison with the auger 14. The knife 48 is interposed between the auger 1 and the plate 40, in shearing relation to the plate.

The auger 14 and the knife 48 are rotated in the clockwise direction, as viewed from the upstream end of the auger. Chunks of meat are impelled by the auger 14 through the casing 16, past the knife 48, which operates to cut the meat as described hereinafter, and through the perforations 41 in the plate 40. The ground meat discharged from the plate 40 is collected for use, large quantities being used for making hamburgers. The improvements provided by the present invention serve to separate the bone particles from the meat at the discharge end of the grinder 18 and remove the bone chips out of the stream of ground meat being conveyed in the conduit 20 upstream of the mixing bin 24, the second stage grinder 34 and the bagging unit 38.

In the preferred embodiment, the plate 40 includes a cylindrical disk-like body portion 54 and an integral generally cylindrical hub portion 56 projecting rearwardly from the body portion. The rim of the body portion 54 is seated in an annular internal recess 58 at the downstream end of the casing 16. The plate extends transversely across the casing 16, perpendicular to the auger 14 and has an axis coincident therewith. The downstream end of the casing 16 also is provided with an external peripheral threaded portion 60. An internally threaded retainer ring 62, in the form of a centrally apertured end cap, includes an inwardly extending shoulder 64 which overlies the rim of the plate 40, and the ring threadedly engages the threaded portion 60 of the casing 16, to removably secure the die plate 40 to the casing.

A smooth cylindrical bearing bore 66 extends through the plate 40 from its upstream face 68 to its downstream face 70, axially of the plate and of the respective body and hub portions 54 and 56 thereof. A substantially enlarged cylindrical counterbore 72 in the body portion 54 surrounds the bearing bore 66 coaxially therewith and adjacent to the upstream face 68. The counterbore 72 is defined by a transverse circular bottom wall and a cylindrical side wall perpendicular thereto and spaced from the bore 66.

To collect and remove bone chips from the ground meat a bone-separation groove 74 is formed in the upstream face 68 of the plate 40. It should be appreciated that the groove 74 can be generally radially extending or an involute or spiral as described in detail in U.S. Pat. No. 4,004,742. The groove 74 is defined by a transverse imperforate bottom wall and by spaced substantially parallel side walls perpendicular thereto. The bottom wall of the groove 74 and the bottom wall of the counterbore 72 lie in the same transverse plane perpendicular to the auger 14 in the illustrative embodiment shown in FIG. 2. The groove 74 has a radially disposed outer end adjacent to the outer periphery of the plate 40, and it terminates at the counterbore 72 in open communication therewith. The groove 74 intersects the side wall of the counterbore, with the mouth of the groove directed to discharge material from the groove into the counterbore 72 adjacent to and along the side wall of the counterbore, in tangential fashion.

The perforations or holes 41 are formed in the body portion 54 of the die plate 40, and they extend between the upstream and downstream faces of the body portion substantially throughout the area of the plate 40, except for the bottom walls and of the counterbore 72 and the groove 74, respectively. Preferably, the perforations 41 are cylindrically shaped or frusto-conically shaped, in the latter case widening in the downstream direction and their diameter is relatively small, for cutting and discharging the meat in ground hamburger size, for example. The perforations 41 reject larger bone particles. The side walls of the bone-separation groove 74, however, are spaced apart for a greater distance than the diameter of the perforations 41, so as to accept both small bone particles and bone particles larger than the perforations.

As shown in FIG. 2, the stud 46 supports the downstream end of the auger 14 in the illustrative embodiment. The stud 46 is an integral one-piece structure having a square-threaded portion 76 adjacent to one end thereof, an enlarged disk-like shoulder portion 78 adjacent to the threaded portion, an octagonal knife-mounting portion 80 adjacent to the shoulder portion, and a generally cylindrical shaft portion 82 adjacent to the knife-mounting portion and to the remaining end of the stud. The threaded portion 76 of the stud 46 is received in a complementary tapped hole 84 in the auger 14, as illustrated in FIG. 2, and the stud is turned into the auger until the rearmost convolution of the auger abuts on the shoulder portion 78, which serves as a stop. The stud 46 is removably connected to the downstream end of the auger 14 in this manner.

The outside diameter of the stud shaft portion 82 is substantially equal to the inside diameter of the plate bearing bore 66, with suitable clearance, and the shaft portion is adapted to be received or journalled in the bearing bore for supporting the auger 14 and the knife 48 on the stud 46 and rotatably in the casing 16 as illustrated in FIG. 2. The knife 48 is supported in shearing relation to the upstream face 68 of the plate 40, the cutting edges 86 of the knife bearing on the upstream face. The position of the auger 14 along the axis of the casing 16 is adjustable, by conventional means not shown, for adjusting the force with which the knife 48 is urged against the plate 40.

The shaft portion 82 of the stud 46 when received in the bearing bore 66, and the walls of the counterbore 72 define an annular bone-collecting pocket 88 (FIG. 2) around the shaft portion. The bone-separation groove 74 extends outwardly from the pocket 88, as described above for the relationship of the groove to the counterbore 72. The structure so far described is generally in accordance with the teachings of U.S. Pat. No. 4,004,742.

In the preferred embodiment, a bone chip removal channel 90 is provided in the form of a recess or groove in the side surface of the shaft 82. When the stud 46 is mounted in operative position in the grinder 18, the recess 90 extends continuously along the shaft portion 82 between the upstream face 68 and the downstream face 70 of the die plate hub 56 for discharging from the grinder the bone chips and hard particles which collect in the pocket 88. The recess 90 may be in the form of a straight or a helical groove and preferably the depth of the groove is about one-half of the radius of the shaft portion 82. As shown in FIGS. 2 and 3, the groove 90 is formed by grinding or machining away a portion of the shaft 82 to form a flat 91 along the length of the shaft. It will be understood, however, that the groove 90 could be machined with a channel-shaped cross section, if desired. The groove 90 is in open communication with the pocket 88 adjacent the upstream end of the shaft 82 and the discharge end of the groove 90, at the downstream end of the shaft, is adjacent the downstream end of the hub portion 56; constituting part of the downstream face 70 of the die plate 40.

As the auger 14 and knife 48 turn in the grinder casing 16, bone chips are swept across the upstream face 68 of the perforated die plate 40 until they are captured in the collecting groove 74 from which they move radially inward into the bone collected pocket 88. When the pocket 88 is full of bone chips, the upstream pressure forces the chips out the discharge channel defined by the groove 90 in the shaft 82 and the inner wall of the bearing bore 66 in the die plate 40. It should also be understood, of course, that other alternative bone chip discharge channels can be provided, such as, for example, a separate bore extending through the hub 56 from the pocket 88 to the hub end face 70 generally radially offset from the bearing bore 66 in which the shaft 82 is located.

In accordance with the present invention means are provided for separately conveying ground meat and bone chips from the discharge end of the grinder 18. To this end a ground meat conduit 20 for receiving ground meat from the perforation in the die plate 40 is connected at its entrance end 92 to the discharge end of the grinder casing 16 such as by the internally threaded annular end cap 62. As shown in FIG. 2, the entrance end 92 of the conduit is formed with a radially outwardly extending flange 93 which is engaged by the shoulder 64 on the end cap 62 and urged against the outer margin of the die plate 40 and the end of the grinder casing 16.

Also pursuant to the invention, a bone chip discharge tube 95 is provided with its inner end received by and secured to the hub 56 surrounding the bone chip discharge channel 90. The other end of the bone chip discharge tube 95 preferably communicates with an opening 96 formed in the wall of the ground meat conduit 20 intermediate the ends thereof. Thus, as bone chips are discharged out of the channel 90 they pass into the tube 95 and are conveyed away out of the stream of ground meat being conveyed out through the conduit 20. The tube 95 may be secured to the hub 56 in any suitable manner such as, for example, by a conventional hose clamp (not shown). Since the tube 95 is only slightly larger in diameter than the hub 56, there is only a minimal restriction to the flow of ground meat being conveyed through the conduit 20.

Pursuant to a further aspect of the invention, means 100 are provided for regulating the flow of bone chips through the discharge tube 95. In the preferred embodiment and as shown in FIGS. 2 and 3, the flow regulating means 100 includes a ball valve 102 connected to the tube 95 by way of a threaded pipe nipple 103 and an internally threaded bushing 104 welded in the opening 96 formed in the wall of the ground meat conduit 20. Preferably, the bushing 104 is flush mounted with the exterior of the conduit wall and ground smooth with the surface thereof. It will be understood that the bushing 104 also serves as a suitable connection for receiving the outer end of the bone chip tube 95. A second pipe nipple 105 may be connected to the ball valve 102 and serve as a direct discharge opening for the bone chips or as a connection to a further bone chip collection or conveying device (not shown).

By adjusting the opening of the ball valve 102, the grinder operator can regulate the flow and discharge of bone chips through the bone chip discharge tube 95 so that the bone chip removal system operates in the most efficient and economical fashion. In this regard, proper adjustment of the valve 102 permits economical operation of the grinder while still obtaining an exceptionally high percentage removal of bone chips with yields in excess of 99% and, indeed, on the order of 99.6 to 99.8% efficiency.

In further keeping with the invention, the downstream end of the conduit 20 is adapted to be received by and secured to the coupling element 22 at the entrance of a downstream ground meat processing unit such as the mixing bin 24 as shown in FIGS. 1 and 3. Typically, such coupling elements 22 are in the form of annular sleeves or collars and are provided with a plurality of thumb screws 23 for removably engaging the outside wall 114 of the conduit 20. It will be noted that in the embodiment shown in FIGS. 1–3, the outside wall 114 of the conduit 20 is substantially straight, i.e., the conduit is essentially of uniform diameter from end to end and the outer end of the bone chip discharge tube 95 and the bushing 104 do not project out beyond the outside wall of the conduit. This permits the threaded end cap 62 of the grinder 18 to be easily slipped along the length of the conduit and off the outer end thereof when it is desired to completely disassemble these parts for cleaning, replacement or other servicing.

Turning now to FIG. 4, an alternate embodiment of the invention is shown. In some meat grinding units presently available, the threaded end cap 62 is formed with an axially extending annular sleeve or collar 116 adapted to be received in and secured directly to the coupling element 22 at the entrance end of a downstream meat processing device such as the mixing bin 24. Accordingly, in this embodiment of the invention, the ground meat conduit 120 is formed with its entrance end adapted to be received by and secured to the axially projecting collar 116 at the discharge end of the grinder cap. The collar 116 is preferably formed with an annular groove 118 into which the ends of thumb screws 121 on the entrance end of the conduit 120 may be seated. While the conduit 120 is generally cylindrical in shape, it is formed with a somewhat smaller diameter adjacent its downstream end 122 which is adapted to be received by and secured in the coupling element 22 on the mixing bin 24. In this embodiment, the end 96 of the bone chip tube 95 may extend through the outside wall of the ground meat conduit 120. As in the previous embodiment, an internally threaded bushing 104 is secured in the tube end 96 for connection of a pipe nipple 103 and ball valve regulator 102. The thumb screws 23 on the coupling element 22 provide for removably securing the conduit 120 to the mixing bin. In this embodiment, it will also be appreciated that, if desired, the conduit 120 can be removed and the mixing bin 24 connected directly to the grinder 18 through the coupling element 22 and collar 116.

Figure 5:
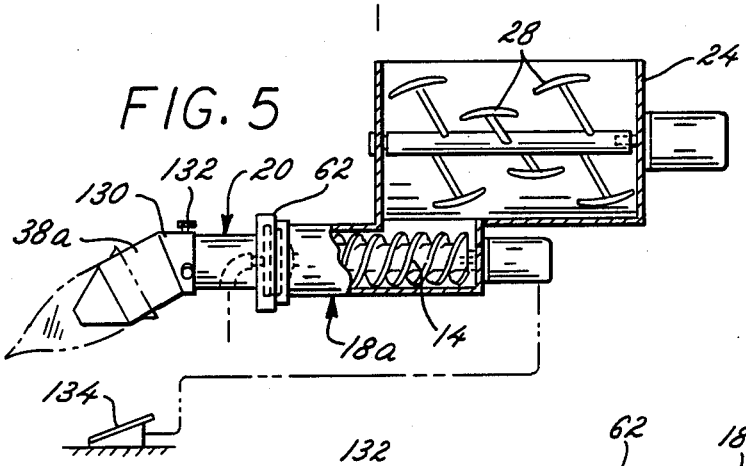
FIG. 5 is a side elevational view, with portions broken away, of an alternative meat mixing, grinding and bagging apparatus employing the novel ground meat conveying conduit and bone chip removal tube of the present invention interposed between the downstream end of the grinder and the bagging unit; and, FIG. 6 is an enlarged fragmentary side elevation view, partly in section of the ground meat conveying conduit and bone chip removal tube of FIG. 5.
Figure 6:
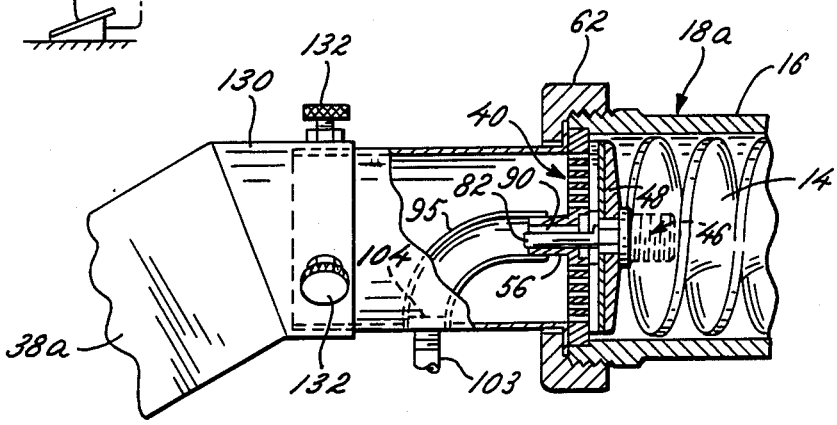

In another embodiment of the invention, as shown in FIGS. 5 and 6, the ground meat conduit 20 and bone chip removal tube 95 may be interposed directly between an upstream meat grinder **18*a* and a downstream meat packaging device or bagging nozzle 38*a*. As shown here, the attachment of the conduit 20 to the grinder 18*a* is the same as is shown in FIGS. 1 and 2 and the downstream end of the conduit is adapted to be received by a coupling ring 130 on the bagging nozzle 38*a* and secured thereto by suitable means such as thumb screws 132. In this embodiment, an operator controlled switch 134 is provided to permit the packaging operator to control the grinder 18*a* and thus start and stop the flow of ground meat through the bagging nozzle 38*a***.

From the foregoing, it will be seen that the present invention provides a relatively simple yet novel bone chip removal and ground meat separating unit for use with meat grinding apparatus having at least one further meat processing device downstream of the grinder. The bone chip removal tube 95 has one end adapted to be secured to the grinder hub 46 for receiving bone chips from the channel 90. The tube has a substantially 90° bend and the other end communicates with an opening 96 in the ground meat conduit 20 for discharging the bone chips out of the stream of ground meat being conveyed through the conduit to a downstream mixer 24 or bagging device 38 or the like.

I claim as my invention:

1. A bone chip removal and ground meat separating unit for use with a meat grinding apparatus having at least one of a further meat grinder, meat mixer and meat packaging device downstream thereof and wherein said grinding apparatus includes a casing and a die plate mounted adjacent a discharge end of the casing, said die plate having a plurality of perforations through which ground meat is extruded and an integral hub with at least one bone chip discharge channel extending therethrough comprising in combination, a ground meat discharge conduit having an entrance end coupled to the discharge end of said casing for receiving ground meat extruded through said perforations and a discharge end connected to one of said further meat grinder, meat mixer, and meat packaging device, and a bone chip removal tube within said conduit having one end secured to said hub for receiving bone chips discharged through said channel and another end communicating with an opening in a side of said conduit downstream of said entrance end thereof and upstream of the discharge end thereof for discharging bone chips out of the stream of ground meat being conveyed through said conduit.

2. A bone chip removal and ground meat separating unit as defined in claim 1 including means for regulating the flow of bone chips through said tube.

3. A bone chip removal and ground meat separating unit as defined in claim 2 wherein said regulating means includes a valve connected to said tube outside of said conduit.

4. A bone chip removal and ground meat separating unit as defined in claim 3 including an internally threaded bushing secured in the end of said tube and a pipe nipple connecting said bushing and said valve.

5. A bone chip removal and ground meat separating unit as defined in claim 4 wherein said bushing is mounted in said discharge conduit flush with the outer wall thereof.

6. A bone chip removal and ground meat separating unit as defined in claim 1 including a centrally apertured end cap secured to said casing for holding said die plate in mounted position adjacent the discharge end of said casing, said conduit being formed with a radially outwardly extending flange adjacent said entrance end and said flange is secured to said casing by said end cap.

7. A bone chip removal and ground meat separating unit as defined in claim 6 wherein the discharge end of said conduit is formed to be removably received by and secured to a coupling element on a downstream ground meat receiving unit.

8. A bone chip removal and ground meat separating unit as defined in claim 1 including a centrally apertured end cap secured to said casing for holding said die plate in mounted position adjacent the discharge end of said casing, said end cap being formed with an axially extending cylindrical sleeve and said entrance end of said conduit is adapted to be secured to said sleeve.

9. A bone chip removal and ground meat separating unit as defined in claim 8 wherein said sleeve is formed to normally receive a coupling element on a downstream ground meat receiving unit and said conduit is formed at said entrance end to be removably received by and secured to said sleeve and the discharge end of said conduit is formed to be removably received by and secured to said coupling element.

10. A bone chip removal and ground meat separating unit as defined in claim 1 wherein said bone chip removal tube is formed with a substantially right angle bend.

11. A bone chip removal and ground meat separating unit for use in line between an upstream rotary meat grinder and a downstream ground meat packaging device, wherein said grinder includes a casing and a die plate mounted adjacent a discharge end of the casing, said die plate having a plurality of perforations through which ground meat is axially extruded and an integral central hub with at least one bone chip discharge channel extending therethrough, comprising in combination, a ground meat discharge conduit having an entrance end adapted to be removably coupled coaxially to the discharge end of said casing for receiving ground extruded axially through said perforations and a discharge end communicating with said meat packaging device, a bone chip removal tube within said conduit having one end adapted to be removably secured coaxially to said central hub for receiving bone chips discharged through said channel and another end communicating with an exit opening in a side of said conduit downstream of said entrance end thereof and upstream of the discharge end thereof for discharging bone chips out of the stream of ground meat being conveyed through said conduit, and coupling means for removably securing the discharge end of said conduit to said ground meat packaging device.

12. A bone chip removal and ground meat separating unit as defined in claim 11 wherein said bone chip removal tube is formed with a substantially right angle end.

13. A bone chip removal and ground meat separating unit as defined in claim 12 including means for regulating the flow of bone chips through said tube.

14. A bone chip removal and ground meat separating unit as defined in claim 13 wherein said regulating means includes a valve connected to said tube outside of said conduit.

15. A bone chip removal and ground meat separating unit for use in line between an upstream rotary meat grinder and a downstream ground meat mixer and wherein said grinder includes a casing and a die plate mounted adjacent a discharge end of the casing, said die plate having a plurality of perforations through which ground meat is axially extruded and an integral central hub with at least one bone chip discharge channel extending therethrough, comprising in combination, a ground meat discharge conduit having an entrance end coupled coaxially to a discharge end of said casing for receiving ground meat end communicating with said downstream meat mixer, a bone chip removal tube within said conduit having one end adapted to be removably secured coaxially to said central hub for receiving bone chips discharged axially through said channel and another end communicating with an exit opening in a side of said conduit downstream of said entrance end thereof and upstream of the discharge end thereof for discharging bone chips out of the stream of ground meat being conveyed through said conduit, and coupling means for removably securing the discharge end of said conduit to said ground meat mixer.

16. A bone chip removal and ground meat separating unit as defined in claim 15 wherein said bone chip removal tube is formed with a substantially right angle bend.

17. A bone chip removal and ground meat separating unit as defined in claim 15 including means for regulating the flow of bone chips through said tube.

18. A bone chip removal and ground meat separating unit as defined in claim 17 wherein said regulating means includes a valve connected to said tube outside of said conduit.

19. A bone chip removal and ground meat separating unit as defined in claim 18 including an internally threaded bushing secured in the end of said tube and a pipe nipple connecting said bushing and said valve.

20. A bone chip removal and ground meat separating unit as defined in claim 19 wherein said bushing is mounted in said discharge conduit flush with the outer wall thereof.

21. A meat grinding and bone chip removal system comprising an upstream meat grinder and a downstream meat processing apparatus, said upstream meat grinder including a casing with a die plate mounted adjacent the discharge end thereof, said die plate having a plurality of perforations through which meat is axially extruded and an integral central hub with at least one bone chip discharge channel extending therethrough, ground meat discharge conduit means having an entrance end removably coupled coaxially to said die plate and a discharge end coupled to said downstream meat processing apparatus, and tubular means within said conduit means having one end secured coaxially to said central hub for receiving bone chips discharged through said channel and another end communicating with an opening in a side of said conduit means downstream of the entrance end thereof and upstream the discharge end thereof for discharging bone chips out of the stream of ground being conveyed through said conduit means.

* * * * *